US006454150B1

(12) United States Patent
Holbrook

(10) Patent No.: US 6,454,150 B1
(45) Date of Patent: Sep. 24, 2002

(54) SOFT-START FEATURE FOR CONTINUOUS WEB CUTTERS

(75) Inventor: Russell W. Holbrook, Southbury, CT (US)

(73) Assignee: Pitney Bowes Inc., Stamford, CT (US)

( * ) Notice: Subject to any disclaimer, the term of this patent is extended or adjusted under 35 U.S.C. 154(b) by 27 days.

(21) Appl. No.: 09/751,063

(22) Filed: Dec. 28, 2000

(51) Int. Cl.[7] ..... B23Q 15/013; B65H 20/00

(52) U.S. Cl. ..... 226/43; 226/8; 226/122; 226/123; 226/138; 399/385

(58) Field of Search ..... 226/8, 43, 48, 226/122, 123, 138; 399/375, 385, 68, 16, 384

(56) References Cited

U.S. PATENT DOCUMENTS 3,025,740 A * 3/1962 Sorkin ..... 226/123 X
3,276,648 A * 10/1966 Lewis, Jr. et al. ..... 226/122 X
3,948,425 A * 4/1976 Bala ..... 226/43
4,633,694 A * 1/1987 Miyazaki ..... 226/8 X
4,795,956 A * 1/1989 Beck ..... 318/638
5,595,335 A * 1/1997 Borel ..... 226/42
6,208,830 B1 * 3/2001 Takeda ..... 399/385

FOREIGN PATENT DOCUMENTS

JP 05273817 * 10/1993 ..... 399/385 X

* cited by examiner

*Primary Examiner*—Michael R. Mansen
*Assistant Examiner*—Minh-Chau Pham
(74) *Attorney, Agent, or Firm*—Christopher J. Capelli; Angelo N. Chaclas

(57) ABSTRACT

A method and device for improving the throughput of a continuous web cutter, which is operated in move-and-pause cycles to allow the web to be cut into cut sheets. To avoid tear and web breakage, the web is fed at a low cycle rate at the starting stage. The cycle rate is progressively increased. When a feed rhythm is developed at the higher cycle rate, a constant cycle rate is maintained for the rest of the web operation.

13 Claims, 5 Drawing Sheets

( PRIOR )

(PRIOR)

(PRIOR)

SOFT-START FEATURE FOR CONTINUOUS WEB CUTTERS

FIELD OF THE INVENTION

The present invention relates generally to continuous web cutters and, more particularly, to the feeding speed of the web cutter.

BACKGROUND OF THE INVENTION

Continuous web cutters are known in the art. As shown in FIG. 1, a continuous web cutter is used to provide cut sheets to an envelope insertion station in a typical envelope inserting machine. Typically, a continuous web of material with sprocket holes (or tractor pin-feed holes) on both sides of the web is fed from a fan-fold stack, or a roll, into the web cutter, which has two moving belts with sprockets (or tractors with pins) to move the web toward a guillotine cutting module for cutting the web cross-wise into cut sheets. Perforations are provided on each side of the web so that the sprocket hole sections of the web can be removed from the cut sheets prior to moving the cut sheets to other components of the envelope inserting machine. In particular, the continuous web cutter, as shown in FIG. 1, is used to feed two webs of material linked by a center perforation. As shown, a splitter is used to split the linked webs into two separate webs before the webs are cut by the cutting module. In general, the web material is driven in move-and-pause cycles, wherein the web material is temporarily paused for a short period to allow the cutter to cut the material into cut sheets. Thus, in each cycle, the web must be accelerated and decelerated. When the acceleration is high, the forces created by the acceleration of the web mass by the driving belt can break the web at a perforation or cause the sprocket holes to tear. Thus, a jam occurs. When high throughput (20,000+cycles per hour) is desired, the acceleration force-induced rip on the sprocket holes is a major limiting factor to the obtainable cycle rate. Furthermore, when the acceleration is high, another force is created by aerodynamic effects, due mainly to wind resistance against the motion of the web. The aerodynamics related force may also break the web at a perforation. For this reason, web cutters are usually operated at a cycle rate much lower than the obtainable cycle rate, affecting the throughput of the envelope inserting machine.

It is advantageous and desirable to provide a method to improve the throughput of web cutters.

SUMMARY OF THE INVENTION

It is a primary object of the present invention to improve the throughput of a continuous web cutter by increasing the cycle rate, while avoiding or reducing the web breakage due to the forces resulting from high acceleration of the web mass. The web mass is fed into the web cutter in move-and-pause cycles to allow a cutter to cut the web into cut sheets when the web mass comes to a pause. It is preferable that the speed profile of the web in each cycle includes an acceleration section, a constant speed section and a deceleration section, with the constant speed in the cycle being referred to as a top-out speed. Accordingly, the above-mentioned object can be achieved by the method of the present invention. The method comprises the steps of feeding the web in the first cycle with the top-out speed equal to a first speed, and feeding the web in the following cycles with the top-out speed being progressively greater than the first speed until the top-out speed reaches a second speed.

In that respect, the web cutter is operated in two states. In the startup state, the cycle rate is continually increased from a low rate to an optimized rate. In the steady state, the cycle rate is substantially constant. Preferably, the optimized rate is the highest cycle rate obtainable in the web cutter without inducing breakage in the web. The highest obtainable rate is determined by many factors. These factors include the material strength of the web and the perforation. The factors may also include how the web is supplied from a fan-fold stage or a roll and whether the roll is actively driven by a driving mechanism. Preferably, the starting low rate is equal to about 60% of the highest obtainable rate. However, the Starting low rate is also determined by similar factors. In addition, the starting low rate may also be determined by how the web is accelerated in the acceleration section. For example, the acceleration can be linear or non-linear and the acceleration rate can be high or low.

Furthermore, when the web cutter is still in the startup state, the increase of the cycle rate can be linear or non-linear.

The method, in accordance with the present invention can be implemented in a continuous web cutter by a device of the present invention. The device comprises a speed controller for feeding the web in the first cycle with the top-out speed equal to a first speed, and feeding the web in the following cycles with the top-out speed being progressively greater than the first speed until the top-out speed reaches a second speed; and an input device, operatively connected to the speed controller, for adjusting the first speed, the second speed and the cycles between the first and second speeds according to the web material.

The present invention will become apparent upon reading the description taken in conjunction with FIGS. 2*a* to 5.

DETAILED DESCRIPTION

Figure 1:
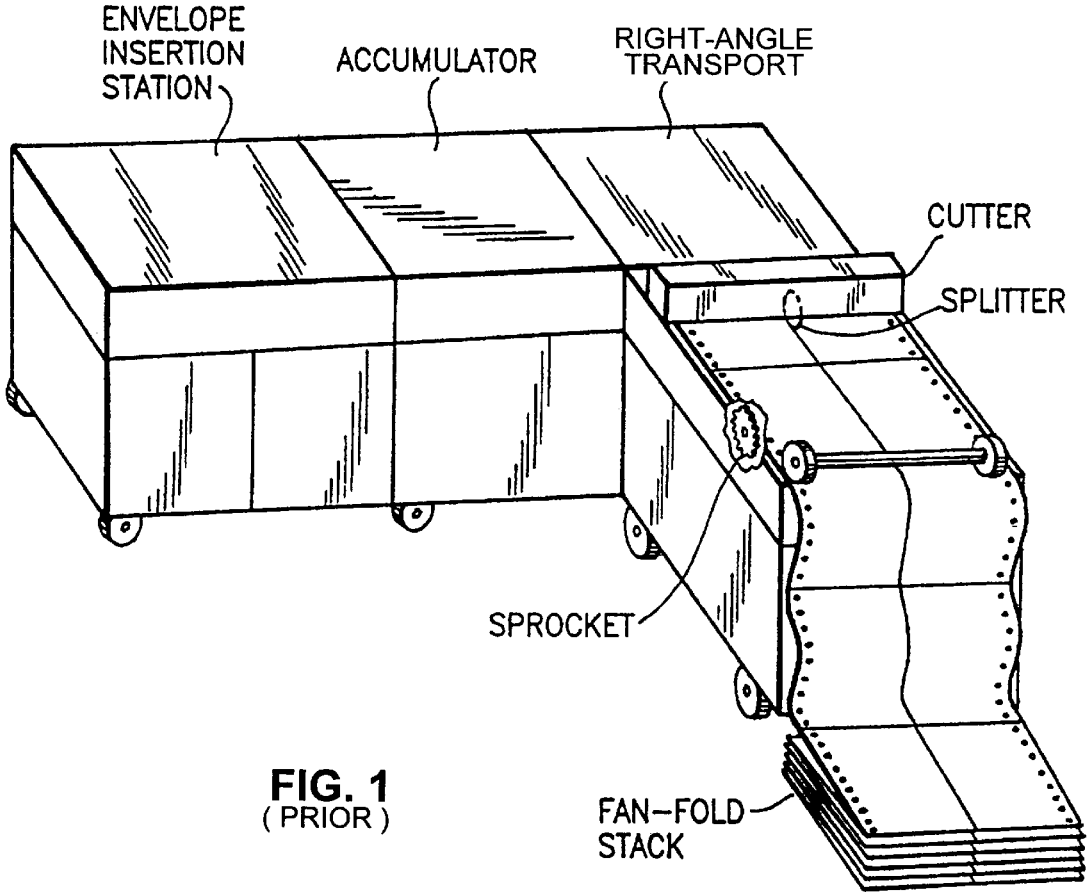
FIG. 1 is a diagrammatic representation illustrating an envelope inserting machine wherein a web cutter is used to provide cut sheets to an envelope insertion station.
Figure 2A:
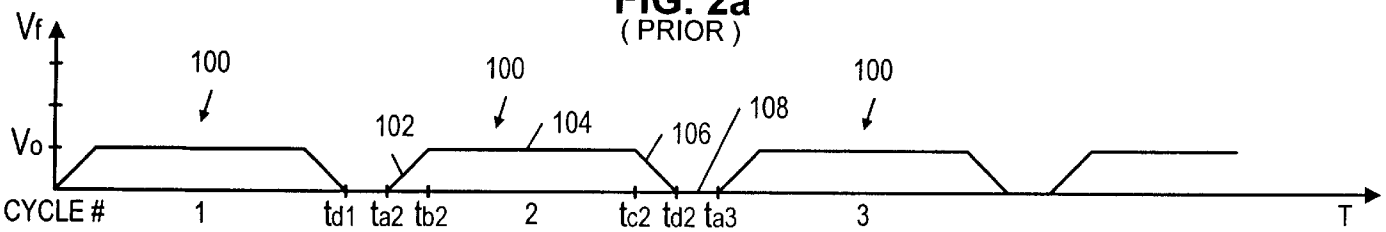
FIG. 2*a* is a timing diagram illustrating the move-and-pause cycles regarding a low cycle rate, wherein the cycle rate is constant.
Figure 2B:
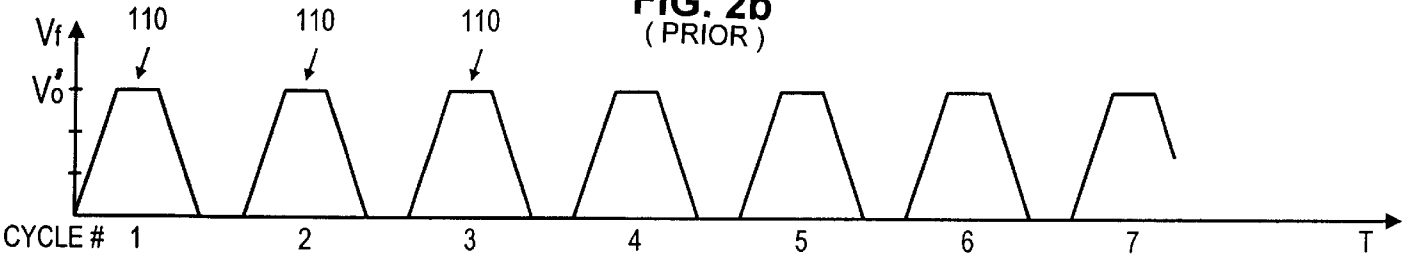
FIG. 2*b* is a timing diagram illustrating the move-and-pause cycles regarding a high cycle rate, wherein the cycle rate is constant.
Figures 3A, 3B, 3C:
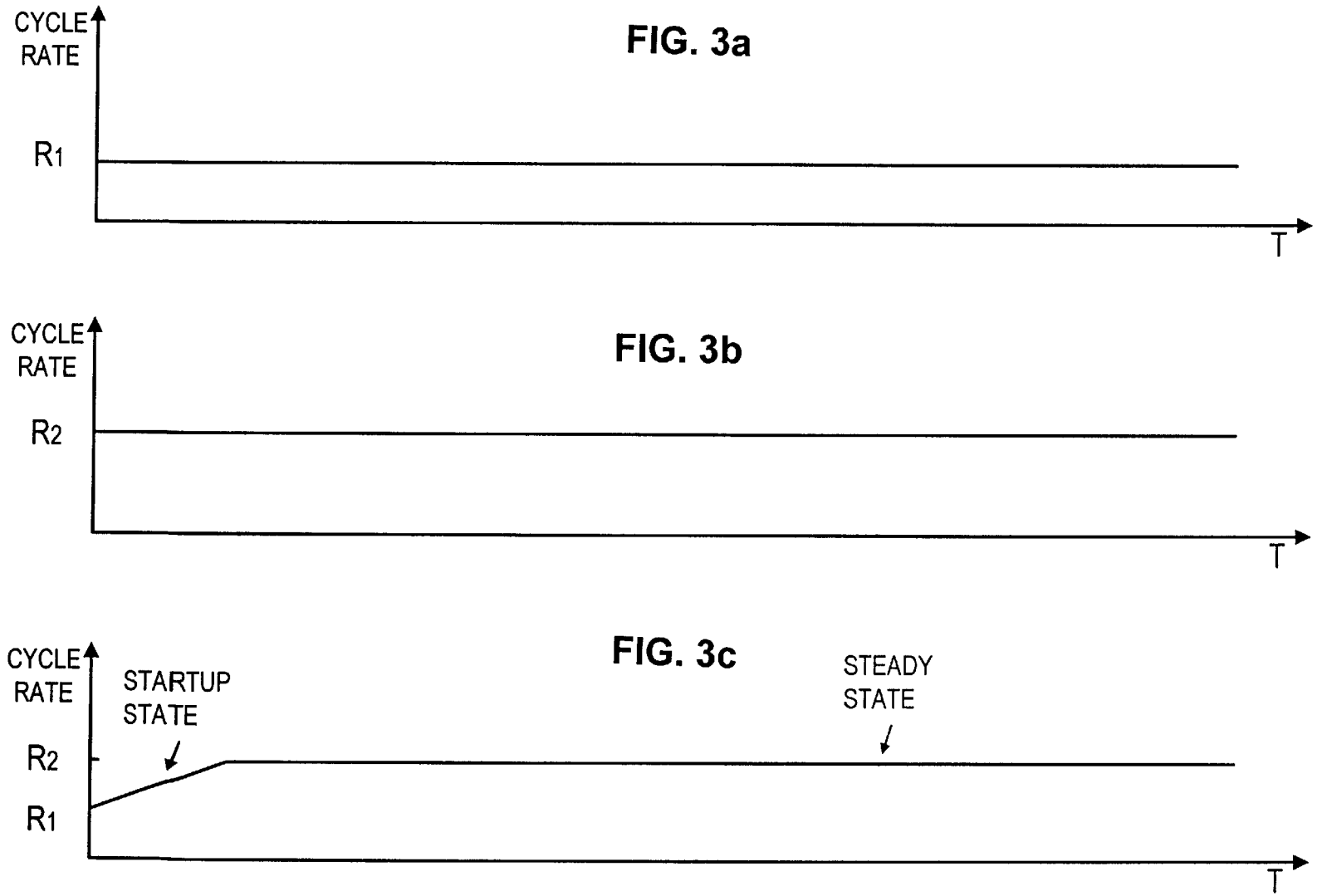
FIG. 3*a* is a plot of cycle rate versus time with a constant low cycle rate.
FIG. 3*b* is a plot of cycle rate versus time with a constant high cycle rate.
FIG. 3*c* is a plot of cycle rate versus time with a non-constant cycle rate.

FIG. 2*a* shows a typical speed profile of a continuous web cutter for feeding the web from a fan-fold stack of materials, as shown in FIG. 1, or a roll of material (not shown). As shown in FIG. 2*a*, the speed profiles 100 in all the cycles are substantially the same. Accordingly, the cycle rate $R_1$, or the number of cycles per unit time, is substantially constant, as depicted in FIG. 3*a*. As shown in FIG. 2*a*, the speed profile 100 can be divided into an acceleration section 102, a constant speed section 104, a deceleration section 106 and a pause section 108. Thus, in each cycle, the web is accelerated from a stationary stage to a certain speed $V_o$. The speed $V_o$ is maintained for a period of time and the web is decelerated to a complete halt to allow a cutter to cut the web cross-wise into sheets. For example, the web is paused after the first cycle from $t_{d1}$ to $t_{a2}$ for cutting. From $t_{a2}$ to $t_{b2}$ in the second cycle, the web is accelerated to the speed $V_o$ and the web is moved with a constant speed from $t_{b2}$ to $t_{c2}$. The constant speed $V_o$ is herein referred to as the top-out speed within a cycle. The web is again decelerated from $t_{c2}$ to $t_{d2}$. FIG. 2*b* shows a similar speed profile 110, except that the acceleration rate and the top-out speed $V_o'$ are much higher than the corresponding rate and speed, as depicted in FIG. 2*a*. Accordingly, the cycle rate $R_2$ regarding the speed profile, as shown in FIG. 2*b*, is about twice the cycle rate $R_1$, as shown in FIG. 3*a*.

It is generally desirable to operate a web cutter in a high cycle rate to achieve a high throughput. However, operating the web cutter at a high cycle rate, as depicted in FIG. 3*b*, usually causes breakage in the web in the first few cycles because of the high accelerating forces associated with the acceleration section of the speed profile for each cycle, as depicted in FIG. 2*b*. The breakage of the web is likely to be caused by two main components to the force imparted on the web during cutter operation. The first component is related to forces created by the acceleration of the web mass by the driving belts or tractors. The second component is related to forces created by aerodynamic effects, generated from wind resistance against the motion of the web. When accelerations are high, these components can break the web at a perforation or cause the tractor pin-feed holes to tear. When high throughput (20,000 cycles per hour or higher, for example) is desired, the acceleration forces on the sprocket (or tractor pin) holes and the aerodynamically induces forces on the web become a limiting factor to the obtainable cycle rate.

Figure 2C:
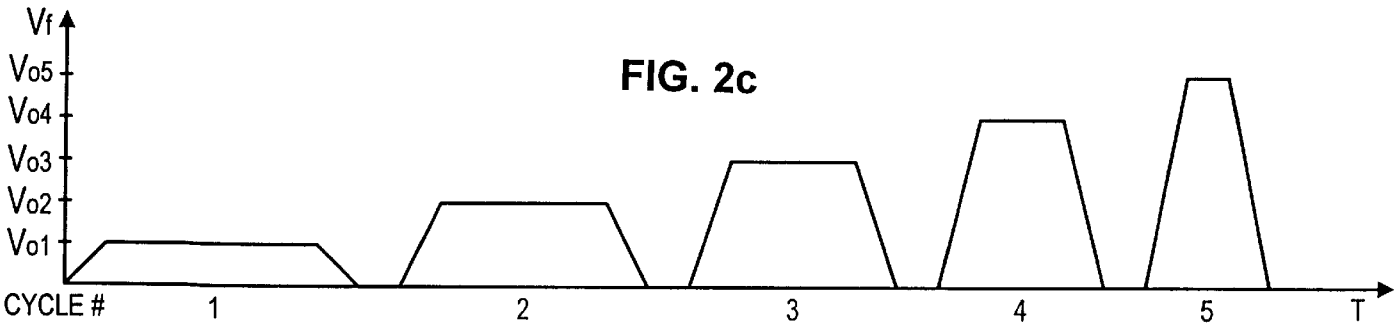
FIG. 2*c* is a timing diagram illustrating the move-and-pause cycles regarding a non-constant cycle rate.

It has been observed that, if the web does not suffer from breakage after a number of cycles, the probability that the web cutter will suffer from a jam due to the breakage is substantially reduced. A plausible explanation to the web breakage reduction is that, when the web cutter operation has reached a feed "rhythm", the web "dances" in the air and creates a buffer loop of web to absorb acceleration-induced shocks to the web. Thus, it is preferable to operate the web cutter at a low cycle rate at the startup state of the operation and progressing increase the cycle rate to an optimized cycle rate. As shown in FIG. 2*c*, the top-out speed of each cycle is increased over the previous cycles until an optimized top-out speed is reached. Accordingly, the cycle rate is changed with time, as depicted in FIG. 3*c*. As shown in FIG. 3*c*, the cycle rate is increased from a lower rate $R_1$ to an optimized cycle rate $R_2$ and then the cycle rate $R_2$ is maintained for the remaining operation. As such, the breakage of the web is eliminated while an optimized throughput can be achieved.

Figure 4A:
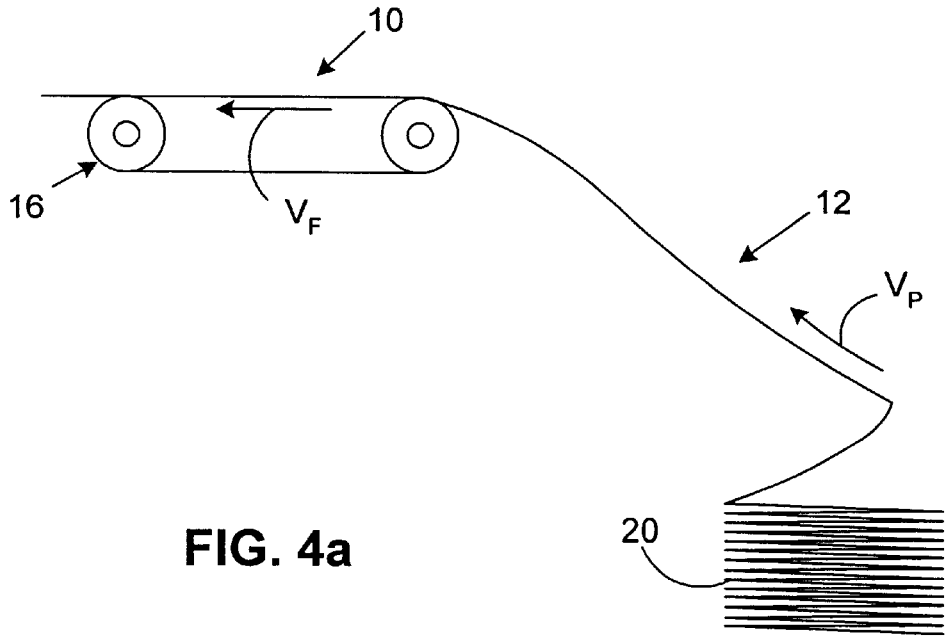
FIG. 4*a* is a diagrammatic representation illustrating a take up portion of the web when the web is operated at a low cycle rate.
Figure 4B:
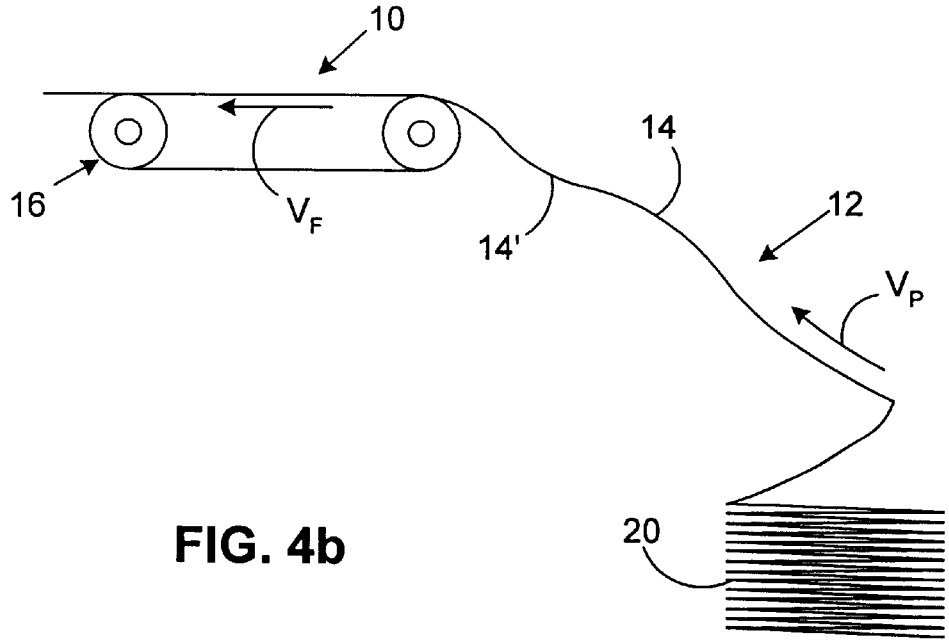
FIG. 4*b* is a diagrammatic representation illustrating the take up portion of the web when the web is operated at a high cycle rate.

The benefit of implementing the non-constant cycle rate, according to the present invention, is illustrated in FIGS. 4*a* and 4*b*. When the cycle rate is low, the pick up speed of the web from the fan-fold stack, as denoted by $V_p$ in FIG. 4*a*, is substantially the same as the feeding speed $V_f$ (see FIG. 2*a*) of the web driven by the sprockets or tractor pins. When $V_f$ is increased in the acceleration section of the move-and-pause cycle to accelerate the web, $V_p$ is increased accordingly. When the web is decelerated, $V_p$ is decreased accordingly. When the web is paused for cutting, $V_p$ is substantially 0. Thus, the pick up section 12 of the web substantially moves along with the driven section 10 of the web, and the speed profile for $V_p$ is similar to the speed profile for $V_f$, as shown in FIG. 2*a*. As shown in FIG. 4*a*, the shape of the pick up section 12 of the web is determined by the force imparted on the paper web by the driving mechanism 16 and the gravity of the web itself. As the cycle rate increases, however, the pick up speed $V_p$ is no longer the same as the feeding speed $V_f$. $V_p$ seems to be out of phase with $V_f$. At a high cycle rate, when the feeding speed $V_f$ is reduced to 0 to allow the driven section 10 to pause between cycles, $V_p$ is reduced but not completely diminished. As a result, the reduced $V_p$ keeps pushing the web upward, creating a buffer loop having some sag sections 14, 14', as shown in FIG. 4*b*. When the driven section 10 is moved again by the driving mechanism 16, the sag sections 14, 14' provide some buffer material until $V_p$ keeps up with $V_f$. Using the non-constant cycle rate, as depicted in FIG. 3*c*, the web is helped to pass the startup period when breakage is most likely to happen. After the feed rhythm is developed, the web can be operated in a much higher cycle rate. By then, the buffer loop in the pickup section 12 effectively reduces the acceleration forces on the sprocket holes and the aerodynamically-induced forces on the web.

Figure 5:
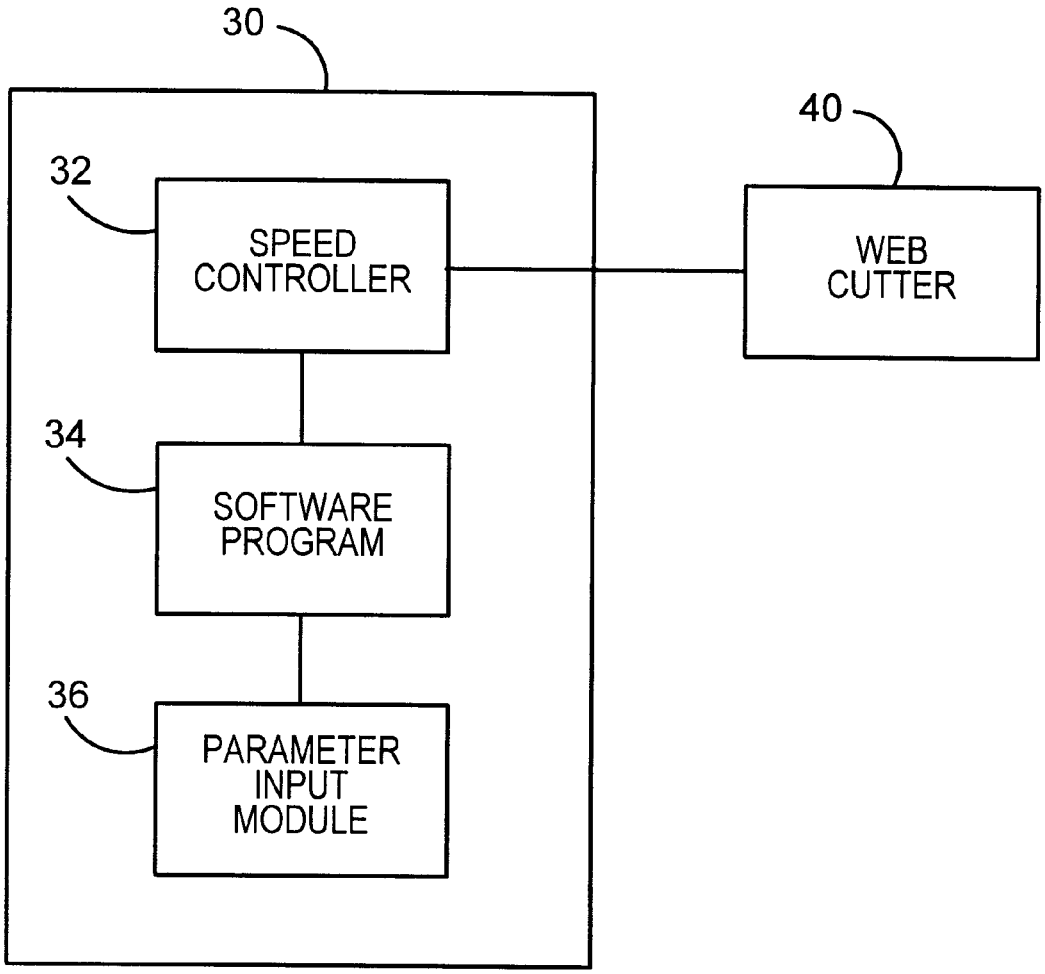
FIG. 5 is a diagrammatic representation illustrating the device for improving the feeding efficiency of a continuous web cutter, according to the present invention.

FIG. 5 illustrates a device 30 for implementing the method of the present invention, as described in conjunction with FIGS. 2*c* and 3*c*. As shown, the device 30 is operatively connected to a continuous web cutter 40. The device 30 comprises a speed controller 32 to control the feeding speed of the web cutter 40, and a user interface 36 to allow a user to input feed speed related parameters such as the starting cycle rate, the cycle rate at the steady state (FIG. 3*c*) and the number of cycles in the startup state. A software program 34, is used to determine the increase of the cycle rate within the startup state. Accordingly, the software program 34 determines the acceleration, the deceleration and the top-out speed in each cycle. However, the user may specify or adjust the acceleration rate and deceleration rate. The user may also specify or adjust the pause period to allow the cutter to cut the web into sheets.

It should be noted that the increase of the cycle rate from the starting rate to the optimized rate, as shown in FIG. 3*c*, is carried out in a linear fashion. It is possible to increase the cycle rate in the startup state in a non-linear fashion. The acceleration and deceleration, as depicted in FIG. 2*c*, is carried out in a linear fashion. It is possible to accelerate and decelerate the web in a non-linear fashion. Moreover, the constant speed section in a move-and-pause cycle, as depicted in FIG. 2*c*, can be shortened or lengthened depending on the acceleration and deceleration rates. It is possible that, at a high cycle rate, the constant speed section can be eliminated. Furthermore, the web is fed into the web cutter from a fan-fold stack 20 on the floor, as depicted in FIGS. 1, 4*a* and 4*c*. The web can be fed from a fan-fold stack from a platform, a cart or a table. The web can also be fed from a roll, which can be set in motion passively by the pull of the web material driven by the web feeder, or can be set in motion by a separate driving mechanism. The cutter can be used to cut a single web or multiple webs.

Thus, although the invention has been described with respect to a preferred embodiment thereof, it will be understood by those skilled in the art that the foregoing and various other changes, omissions and deviations in the form and detail thereof may be made without departing from the spirit and scope of this invention.

What is claimed is:

1. A method of improving feeding efficiency of a web cutter, wherein a web of material is fed with move-and-pause cycles with each move-and-pause cycle having a respective top-out speed, said method comprising the steps of:

feeding the web in at least one starting move-and pause cycle having a top-out speed equal to a first speed; and feeding the web subsequent to the at least one starting move-and-pause cycle in subsequent move-and-pause cycles whereby each subsequent move-and-pause cycle has a respective top-out speed being progressively greater than the first speed until a second speed is reached.

2. The method of claim 1, wherein each move-and-pause cycle has an acceleration section, a constant speed section and a deceleration section, wherein a feeding speed in the constant speed section is equal to the top-out speed.

3. The method of claim 1, further comprising the step of stopping the web between adjacent move-and-pause cycles for facilitating cutting the web into sheets.

4. The method of claim 3, wherein at least one move-and-pause cycle has an acceleration section, a constant speed section having a speed equal the top-out-speed, a deceleration section, and a pause section.

5. The method of claim 1, wherein at least one move-and-pause cycle has an acceleration section for speeding up the web to a top-out speed for said at least one move-and pause cycle and a deceleration section for slowing down the web until the web reaches a halt.

6. The method of claim 5, wherein the acceleration section is defined by an acceleration rate, and wherein the acceleration rate is adjustable.

7. The method of claim 5, wherein the deceleration section is defined by a deceleration rate, and wherein the deceleration rate is adjustable.

8. The method of claim 1, wherein the top-out speed increases from the first speed to the second speed in a linear fashion.

9. The method of claim 1, wherein the top-out speed increases from the first speed to the second speed in a non-linear fashion.

10. The method of claim 1, wherein the web comprises a single web of material.

11. The method of claim 1, wherein the first speed is adjustable.

12. The method of claim 1, wherein the second speed is adjustable.

13. A device for improving feeding efficiency of a web cutter, wherein a web of material is with a plurality of move-and-pause cycles with each of said move-and-pause cycle having a respective top-out speed, said device comprising:

means for inputting a first speed and a second speed; and means for controlling feeding of the web in at least one starting move-and-pause cycle having the top-out speed of the at least one starting move-and-pause cycle equal to the first speed and in each move-and-pause cycle following the at least one starting move-and-pause cycle having a respective top-out speed being progressively greater than the first speed until the respective top-out speed reaches the second speed.

* * * * *